US005127107A

United States Patent [19]

Wood et al.

[11] Patent Number: 5,127,107

[45] Date of Patent: Jul. 7, 1992

[54] REVERSIBLE COSTUME STRUCTURE WITH TWO DIFFERENT COSTUME DESIGNS

[75] Inventors: Patrick J. Wood, 404 Maxwell Dr., Pittsburgh, Pa. 15236; Mary F. Wood, Pittsburgh, Pa.

[73] Assignee: Patrick J. Wood, Pittsburgh, Pa.

[21] Appl. No.: 703,693

[22] Filed: May 20, 1991

Related U.S. Application Data

[62] Division of Ser. No. 574,467, Aug. 28, 1990.

[51] Int. Cl.[5] ..... A41D 3/08

[52] U.S. Cl. ..... 2/84; 2/69; 2/88; 2/173; 2/202; 2/206; 2/247; 2/250; 2/DIG. 2

[58] Field of Search ..... 2/84, 69, 69.5, 86, 2/88, 89, 173, 202, 206, DIG. 2, 247, 250; 446/26, 27, 28

[56] References Cited

U.S. PATENT DOCUMENTS

| | | | |
|---|---|---|---|
| D. 168,822 | 2/1953 | Bland | 2/84 |
| 219,243 | 9/1979 | Frankl | 2/84 |
| 2,136,889 | 11/1938 | Richards | 2/84 |
| 2,150,171 | 3/1939 | Kolly | 2/84 |
| 2,408,662 | 10/1946 | Levitt | 2/84 |
| 2,500,982 | 3/1950 | Fligel | 246/84 |
| 2,682,056 | 6/1954 | Werber | 2/84 |
| 3,147,490 | 9/1964 | Allen et al. | 2/84 |

*Primary Examiner*—Werner H. Schroeder
*Assistant Examiner*—Gloria Hale
*Attorney, Agent, or Firm*—John M. Adams

[57] ABSTRACT

A loose fitting garment for use as a costume on a doll or an adult is styled for presentation of a first selected costume design. The loose fitting garment includes, on one surface, a design corresponding to the style for the first selected costume design. The opposite or second surface of the garment includes a design representative of a second selected costume design. The garment is reversible to convert the costume from the first selected costume design to the second selected costume design. To facilitate a change in the costume, the garment includes a mask which is featured as a part of the costume for the second selected costume design. The mask is secured to the garment in a position to be concealed from view when the garment is presented to display the first selected costume design on the wearer. To convert the garment from the first selected costume design to the second selected costume design, the mask is withdrawn and positioned on the wearer so that the mask is suspended by the garment over the head of the wearer to overlie the face of the wearer to conceal the identity of the wearer and present an image representative of the design of the garment for the second selected costume design.

13 Claims, 5 Drawing Sheets

REVERSIBLE COSTUME STRUCTURE WITH TWO DIFFERENT COSTUME DESIGNS

This application is a division of application Ser. No. 574,467, filed Aug. 28, 1990.

BACKGROUND OF THE INVENTION

1. Field of the Invention

This invention relates to construction of a doll that permits the doll to take on a plurality of different characters by conversion of the doll from one character to another and more particularly to a costume construction for the conversion of one costumed character to another type of costumed character.

2. Description of the Prior Art

In the construction of puppets, dolls and the like it is well known to interchange the face portion of a doll or puppet to provide a multiple of characters, such as disclosed in U.S. Pat. Nos. 2,199,049; 3,106,041; and 3,419,993. U.S. Pat. No. 3,106,041 discloses a wide variety of face masks formed of a flexible resilient material which, when applied to the basic face configuration, remains on a puppet head because of the close fit and frictional engagement therebetween. It is also known that the gripping of the face mask with the puppet head can be improved by having the sides of the mask terminate in front of the ears on the sides of the head. Also, pins can be used for holding the mask on the head, as well as an elastic string.

To facilitate the change of expression in the face of a doll, it is disclosed in U.S. Pat. No. 2,199,049 to provide a toy in the form of a doll with a head having a countersunk face side, leaving a margin for receiving a convex face plate which is printed or photographed with an image of a human face or, in the case of animals, an animal face. Spring strips on the front portion of the head engage a mask. With this arrangement a number of masks are provided to simulate a crying, laughing, or serious child.

As disclosed in U.S. Pat. No. 3,419,993, a basic figure is provided and individual body parts are used as accessories to construct various types of ethnic features for a doll, including facial features.

U.S. Pat. No. 1,059,178 discloses a doll having one fixed or permanent face and then superimposed on the fixed face are removable faces. The removable faces are connected to the fixed face. All the faces may be superimposed on one another with only the face being exposed while the remaining faces are out of sight when not in use. The faces are connected at the neck portion of the doll and are turned down and hidden under the clothing of the doll when not in use. A band-type device is provided to hold the desired face in position. When a facial expression is to be changed, a pin is removed so that the unwanted faces can be folded down and arranged under the dress of the doll out of sight. The face to be used is extended over the head of the doll and pinned in place.

U.S. Pat. Nos. 3,851,419; 4,639,233; 4,734,075; and 4,842,565 all disclose dolls in which the character of the doll is changed by turning or reversing the doll inside out. With this construction, a single doll can be converted to different types of characters, as for example, converting between a babydoll figure and an animal figure. With this type of convertible doll construction, a hollow interior is provided, and the doll is turned upside down in order to effect the change from one configuration to another.

While it is well known to construct a doll to facilitate the conversion of the doll in either dress or facial expression from one character to another, there is need to provide means for incorporating within the doll construction a disguise that facilitates the change in not only the facial expression of the doll but the character of the clothing and dress of the doll. In child'play the concept of role playing is intriguing and to accommodate the conversion from one character to another it is important that the disguise of the doll convey one character while the features of another character are not revealed. The known concepts of overlying a mask on a doll's face to convert the doll from one character to another requires complex connections of the mask to the doll's face, which connections are not easily made by a child, and in many cases, involve fastening devices that become displaced or are difficult for a child to utilize.

Therefore there is need for a doll construction or costume that facilitates efficient conversion of a doll or costume from one character to another by which the facial expression of the doll or expression of the costume may be changed without the requirement of elaborate connecting means to be used in the conversion from one character to another.

SUMMARY OF THE INVENTION

In accordance with the present invention there is provided a multiple character doll that includes a doll body having a supporting torso with a head portion connected thereto. The head portion has a face. A loose fitting garment is draped around the torso. The loose fitting garment has one surface style for presentation as a first doll character and an opposite surface style for presentation as a second doll character. A face mask is positioned over the face to change the character of the doll from the first character to the second character. Means for securing the face mask to the loose fitting garment positions the face mask over the doll face to disguise the doll face when the doll is presented as the second character. Storage means on the loose fitting garment receives the face mask concealed from view to convert the doll from the second character to the first character.

Further in accordance with the present invention there is provided a costume construction that includes a loose fitting garment for draping over the body of a wearer of the costume construction. The garment has a first surface with a style presenting a first costume design and a second surface with another style presenting a second costume design. The garment is reversible to convert the style thereof to a selected one of the first and second costume designs. A face mask is provided for use with the loose fitting garment. Means for connecting the face mask to the loose fitting garment supports the face mask from the loose fitting garment in a position overlying the face of the wearer. Means is provided for retaining the face mask connected to the loose fitting garment and concealed from view when removed from position on the face of the wearer.

An additional feature of the present invention is directed to a method for changing a costume from one character presentation to another that includes the steps of positioning a portion of a loose fitting garment styled for presentation as a first selected character of a costume on a wearer. Another portion of the loose fitting garment styled for presentation as a second selected character of a costume is concealed from view on the wearer. A face mask is connected to the loose fitting garment for wearing in the presentation of the first selected character. The face mask is supported from the loose fitting garment for positioning the face mask over the face of the wearer to portray the first selected character. The loose fitting garment is changed on the wearer to conceal from view the first selected character and expose the second selected character. The face mask is removed from the face of the wearer. The face mask is concealed on the loose fitting garment to convert the costume from the presentation of the first selected character to presentation of the second selected character.

According, the principal object of the present invention is to provide method and apparatus for converting the costume of a doll from one style to another by incorporating in the garment of the doll masks and other accessories which are moved from a concealed position on presenting one character to a position on the doll to present another character.

Another object of the present invention is to provide a costume construction that includes a loose fitting garment, such as a cape, styled for wear to present a preselected character in a costume and then convert the costume to another character by the use of a mask retained in a concealed position and withdrawn for positioning on the face of the wearer in the presentation of a second character.

A further object of the present invention is to provide a costume that includes garments styled for presentation of one character and, when reversed, present another character to permit the wearer to convert the costume in roll playing from one character to another.

An additional object of the present invention is to provide a costume construction for use by individuals that incorporates a mask attached to the costume which, when worn, presents a first character and in the conversion of the costume to a second character, the mask is removed to conceal from view and incorporated in the design of the second character.

These and other objects of the present invention will be more completely disclosed and described in the following specification, accompanying drawings, and appended claims.

DESCRIPTION OF THE PREFERRED EMBODIMENTS

Figure 1:
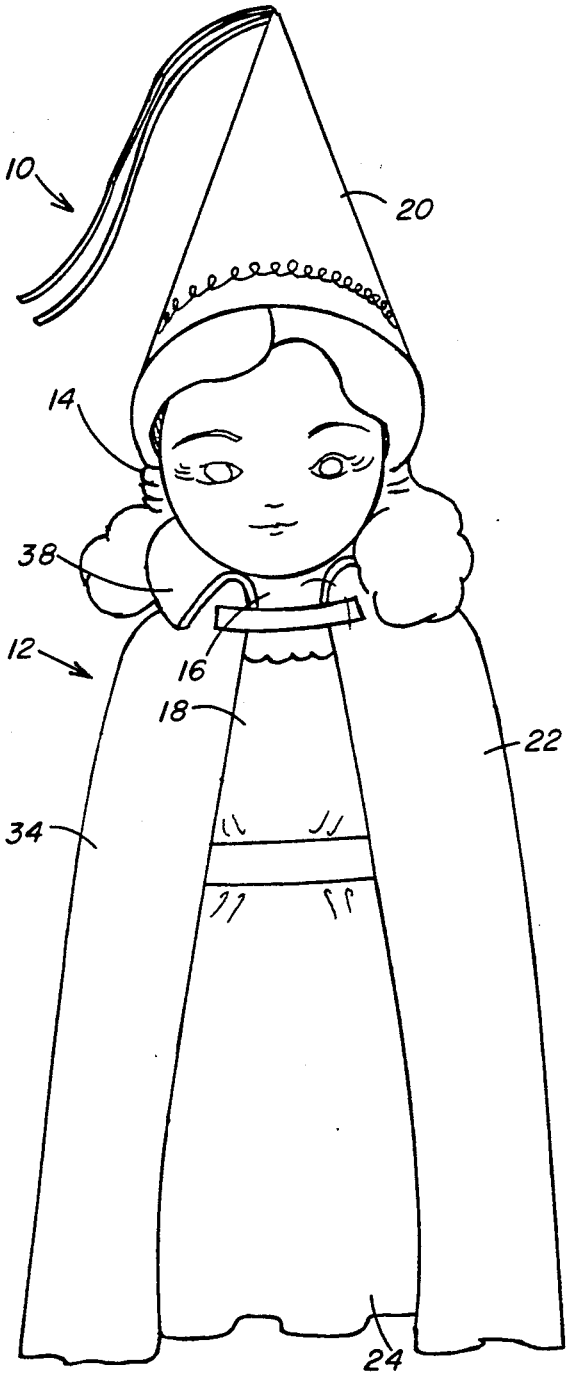
FIG. 1 is a front elevational view of a doll dressed in a costume conveying a specific character.
Figure 2:
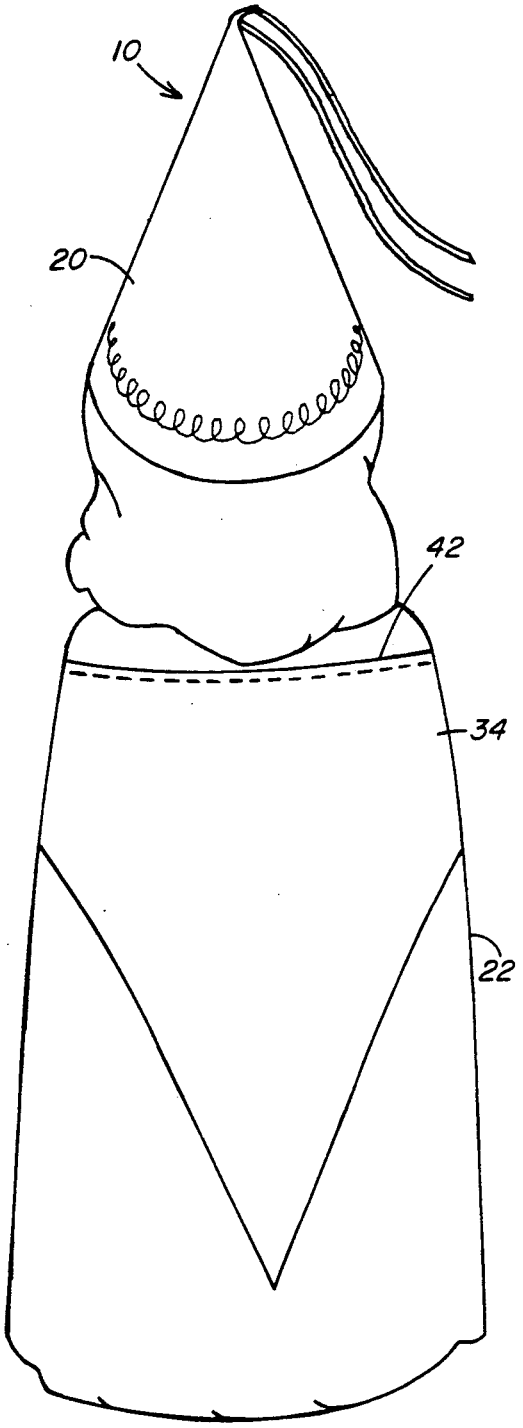
FIG. 2 is a rear view of the doll construction shown in FIG. 1.

Referring to the drawings and particularly to FIGS. 1 and 2, there is illustrated a doll and costume construction generally designated by the numeral 10 having a body 12 that includes a head portion having a face 14 and connected by neck 16 to a supporting torso 18 including arms and legs not shown. The body may be a soft sculpture or hard molded. Also, the body 12 in another embodiment, is construction as a puppet having the face 14, neck 16 and torso 18.

The doll construction shown in FIGS. 1 and 2 includes a costume comprising articles of clothing that include a hat 20 and loose fitting garments such as a cape 22 and dress 24. The style of the hat 20, cape 22 and dress 24 is selective. Other articles of apparel may be utilized such as hats, scarfs, shirts, trousers and the like. For example, the doll construction shown in FIGS. 1 and 2 is styled to be representative of a "fairy godmother" character. The articles of clothing of the doll or puppet construction may be styled to be representative of other types of characters.

Figure 3:
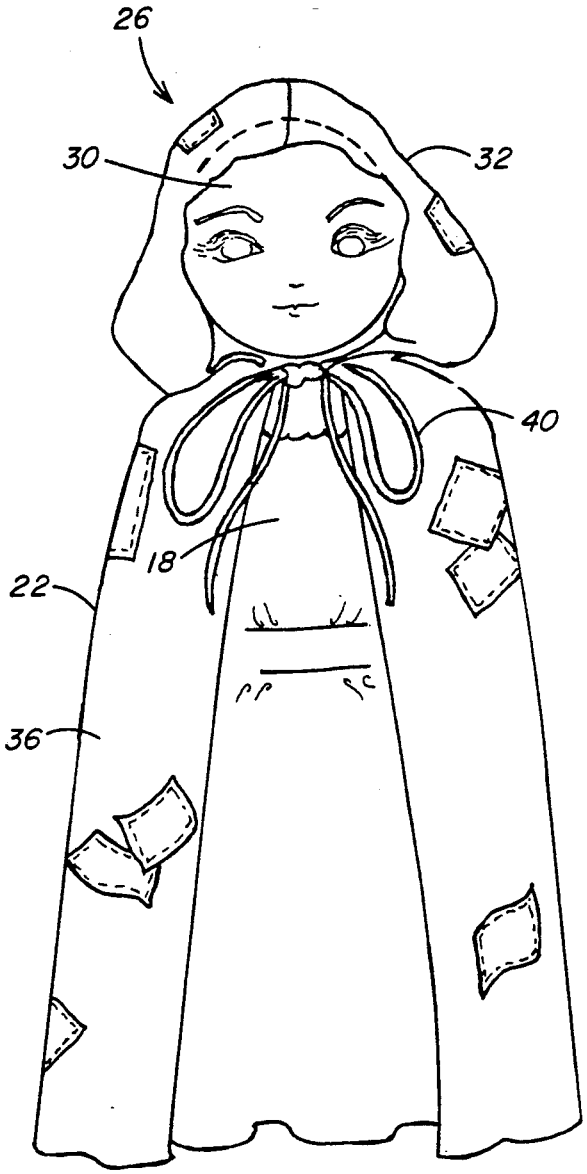
FIG. 3 is a front elevational view of the doll construction converted from the character shown in FIG. 1 to another character by utilizing a mask integral with a hood that overlies the basic face of the doll.
Figure 4:
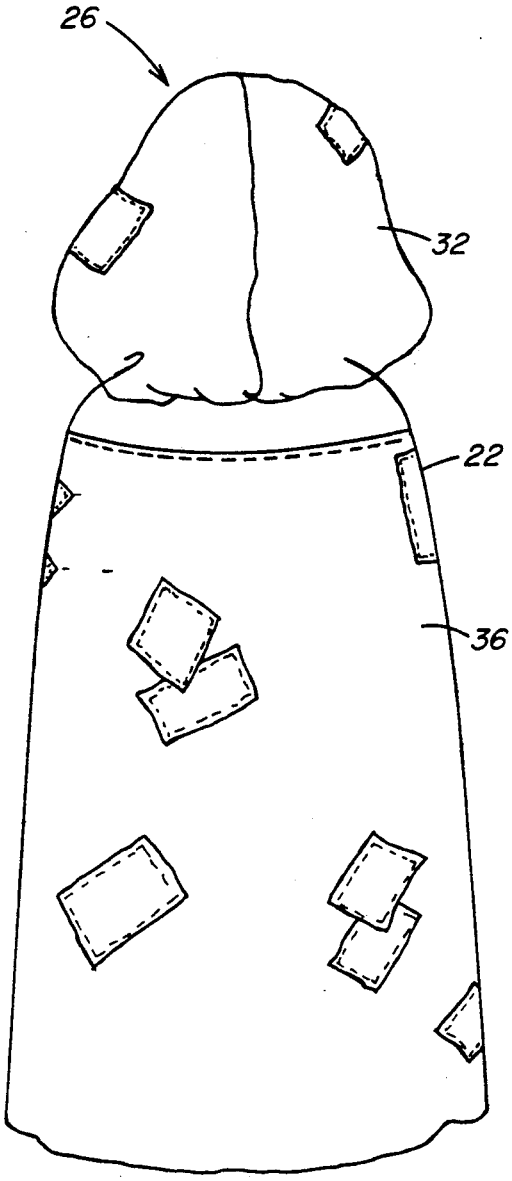
FIG. 4 is a rear elevational view of the doll construction shown in FIG. 3.

In the embodiment shown in FIG. 1, the "fairy godmother" character serves as the basic character which is converted, in accordance with the present invention, to a "peasant lady" doll or puppet character, generally designated by the numeral 26 in FIGS. 3 and 4. The conversion of the doll or puppet construction 10 from the character shown in FIGS. 1 and 2 to the character shown in FIGS. 3 and 4 is accomplished by the provision of a face mask, generally designated by the numeral 28 in FIG. 5.

Figure 5:
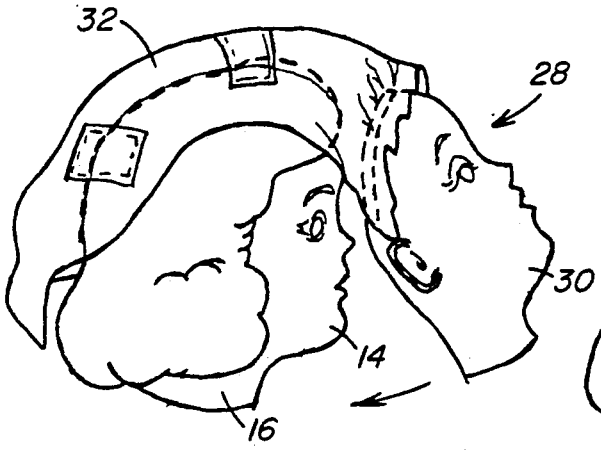
FIG. 5 is a fragmentary schematic illustration of the head of the doll shown in FIG. 1, illustrating the conversion of the doll by use of an overlying mask to the character shown in FIG. 3.

The face mask 28 shown in FIG. 5 includes a face portion 30 molded for complementary positioning on the face 14 of the doll head as shown in FIG. 3. Attached to the face portion 30 at the equivalent of the hairline thereof is a top portion 32 of the cape 22. The top portion 32 is connected to and extends from a cape collar 38.

The loose fitting cape 22 is reversible to accommodate the conversion of the doll or puppet construction from the "fairy godmother" character, shown in FIGS. 1 and 2, to the "peasant lady" character 26, shown in FIGS. 3 and 4. Accordingly, as shown in FIG. 7, the design of the cape 22 has one surface 34 characteristic of the "fairy godmother" character and on the other side, surface 36 designed for the "peasant lady" character 26.

Figure 7:
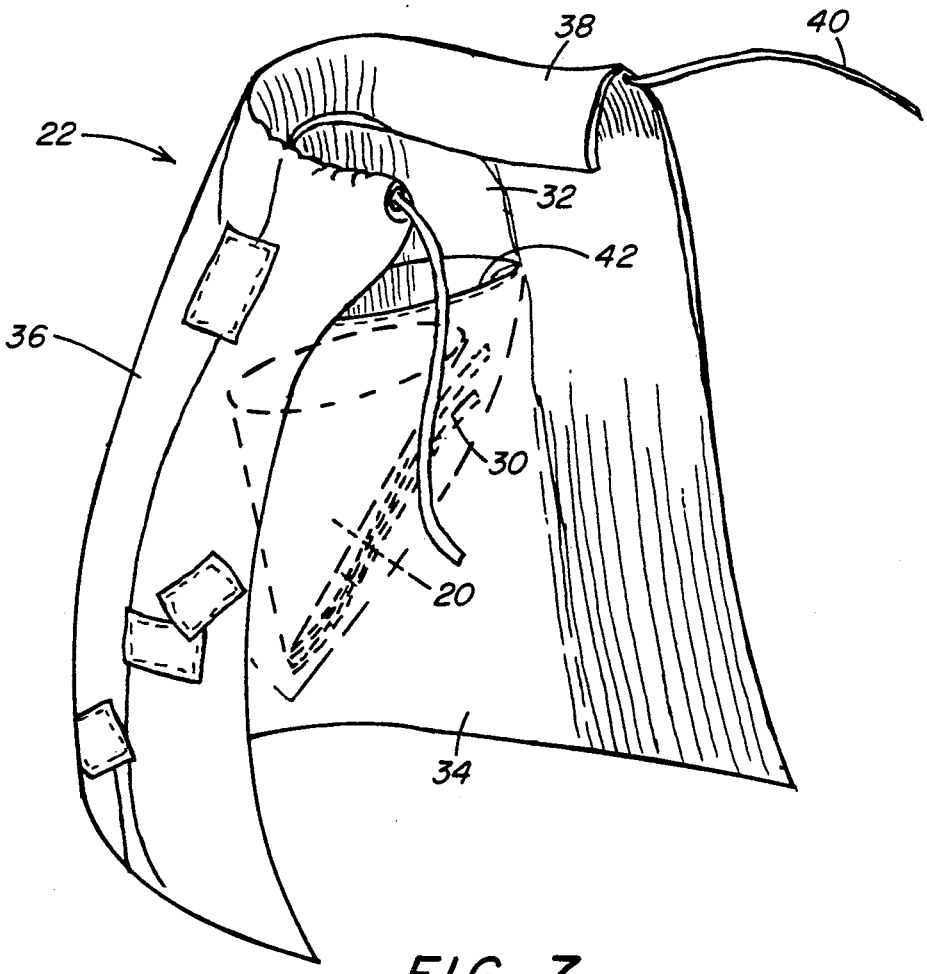
FIG. 7 is a schematic isometric view of a cape used with the doll constructions shown in FIGS. 1 and 3, illustrating a pocket on one surface of the cape for concealing the hat of the doll shown in FIGS. 1 and 2 when the doll is converted to the character shown in FIGS. 3 and 4.

Referring to FIG. 7, the cape 22 is shown in detail having opposite cape surfaces 34 and 36 with the collar 38 at the top portion of the cape and drawstring 40. The cape 22 on surface 34 includes a compartment or pocket 42 for receiving the top portion or hood 32 of the cape 22 with attached face 28 as well as the hat 20. When the cape 22 is draped around the torso 18 for use in developing the "fairy godmother" character shown in FIGS. 1 and 2, the top portion 32 and connected mask 28 are stored in the pocket 42. When the cape 22 is draped around the torso 18 as shown in FIG. 1, the mask 28 is not visible in the pocket 42. When the cape 22 is positioned on the doll as shown in FIGS. 3 and 4, the hat 20 is stored in a concealed manner in the pocket 42. The pocket 42 may also be positioned along the seam of the cape that extends around the cape peripherial edge.

To make the conversion from the "fairy godmother" character shown in FIGS. 1 and 2 to the "peasant lady" character shown in FIGS. 3 and 4, the cape 22 is removed from the doll to permit withdrawal of the mask 28 from the pocket 42. When the mask 28 is withdrawn, the cape is reversed and positioned on the doll construction 10 so that the face portion 30 of the mask 28 overlies the face 14 of the doll or puppet construction as shown in FIG. 5. The portion 32 which connects the mask 28 to the cape is then drawn over the head of the doll so as to conceal the doll hair and form a hood of the cape 22 as shown in FIGS. 3 and 4. The drawstring 40 of the cape 22 is then drawn tightly around the mask 28 overlying the doll face 14 to securely position the mask 28 over the face 14, thereby concealing the face therebeneath. In this manner the doll or puppet construction is converted from one character to another in a fashion that conceals the basic facial configuration of the doll or puppet with a disguise that is incorporated into the doll or puppet construction 10.

Accordingly, to convert the doll or puppet construction 10 from the "peasant lady" character shown in FIGS. 3 and 4 to the "fairy godmother" character shown in FIGS. 1 and 2, the cape 22 with the attached mask 28 is removed. The hat 20, having been stored in the pocket 42, is removed. Thereafter the mask 28 and top or hood portion 32 of the cape 22 are folded into the pocket 42. The cape 22 is turned around so that the cape surface 34 is exposed when positioned around the doll or puppet construction as shown in FIGS. 1 and 2. The hat 20 is then placed on the doll.

The doll or puppet construction 10 of the present invention facilitates efficient conversion of one character to another that is easily accomplished by a very young child. It permits the child to exercise a degree of imagination and creativity in playing with a doll or puppet. The character conversion does not require complex connections that would otherwise be difficult for the child to carry out. At the same time, the conversion is made so that the costume parts remain securely in place during play with the doll or puppet.

The present invention of the doll or puppet construction 10 is also adaptable for use as a costume system for both children and adults. In this context, the child or adult corresponds to basic doll body 12, shown in FIGS. 1 and 2, and the doll face 14 is the face of a child or adult. The cape 22 and hat 20 are worn by the child or adult as a costume representative of a "fairy godmother". This permits the child to participate in play acting as a "fairy godmother". For adult use, the cape 22 and hat 20 are worn as a first costume for role playing as well, for example, in a dramatic production, and is connected to a second costume for another role or to disguise the first costume.

The child or adult converts to another character in the role playing by reversing the cape 22 as above described for presentation as a "peasant lady" shown in FIGS. 3 and 4. The individual's face, corresponding to the doll face 14, is concealed by the face mask 28 attached by the hood 32 to the cape 22. In this manner, a reversal of roles for play, disguising characters in a dramatic presentation, costuming, and the like, are carried out. At least two costumes are available with the single cape 22 and associated accessories stored on the cape can be used to generate additional characters. Accordingly, numerous combinations of characters can be embodied in the doll and costume construction 10 described above.

Figure 6:
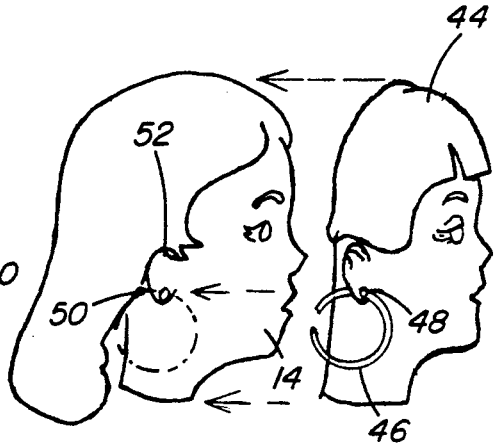
FIG. 6 is an enlarged fragmentary schematic illustration of the conversion of the face of the doll from one character to another using a mask.

Referring to FIG. 6 there is schematically illustrated the conversion of doll face 12 from one character to another by a mask 44 which is a separate element having an inner surface that conforms to the doll face 14. With this arrangement, the doll face 14 receives the mask 44 to permit a change in facial appearance and expression of the doll. The mask 44 is maintained in position on the doll face 14 by the use of earrings 46 having a pin 48 that is inserted within a hole 50 located at the base of ear 52. First, the mask 44 with the earrings 46 removed is positioned in overlying position on the face 14. The pins 48 of the earrings 46 are then extended through the surface of the mask 44 into the holes 50. This secures the mask 44 on the face 14. This type of connection of a mask to a doll for character conversion is suited for use by older children that can manipulate the connection. It also serves as a means for changing the character of the doll by use of accessories, such as earrings, which allow mounting of the mask 44 on the face 14.

Figure 8:
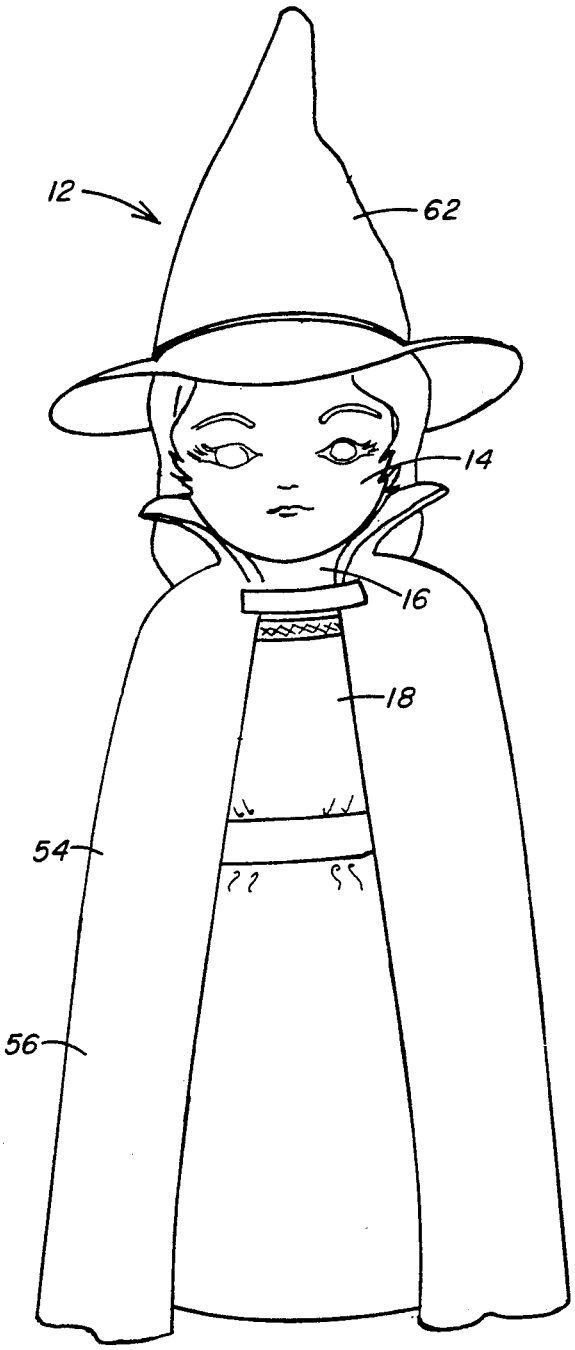
FIG. 8 is another front elevational view of the doll construction in accordance with the present invention.
Figure 9:
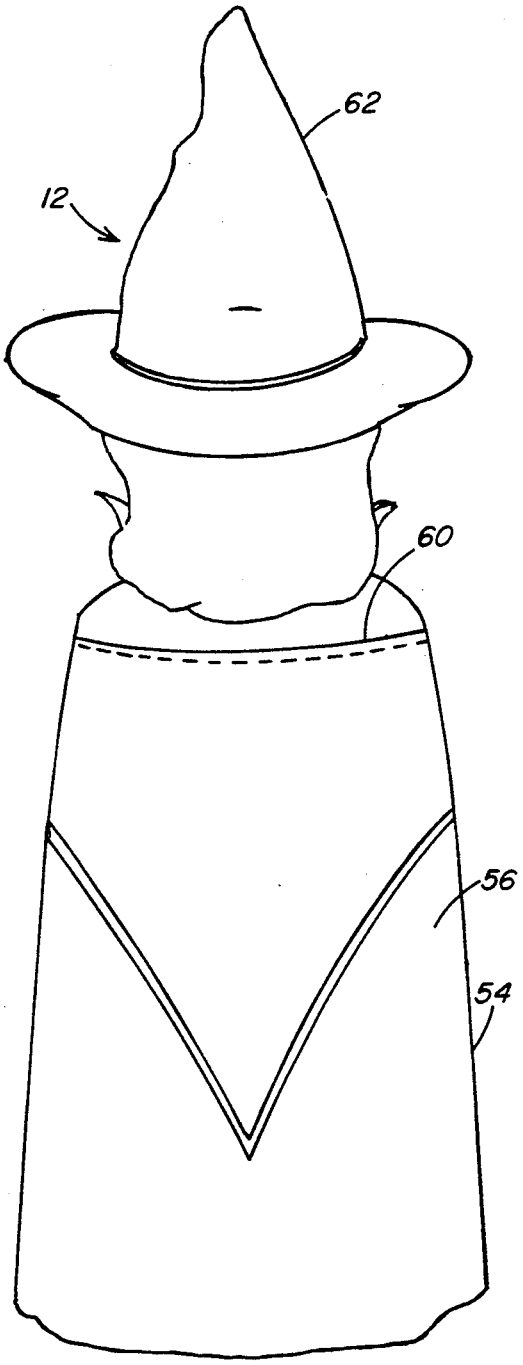
FIG. 9 is a rear elevational view of the doll construction shown in FIG. 8.
Figure 10:
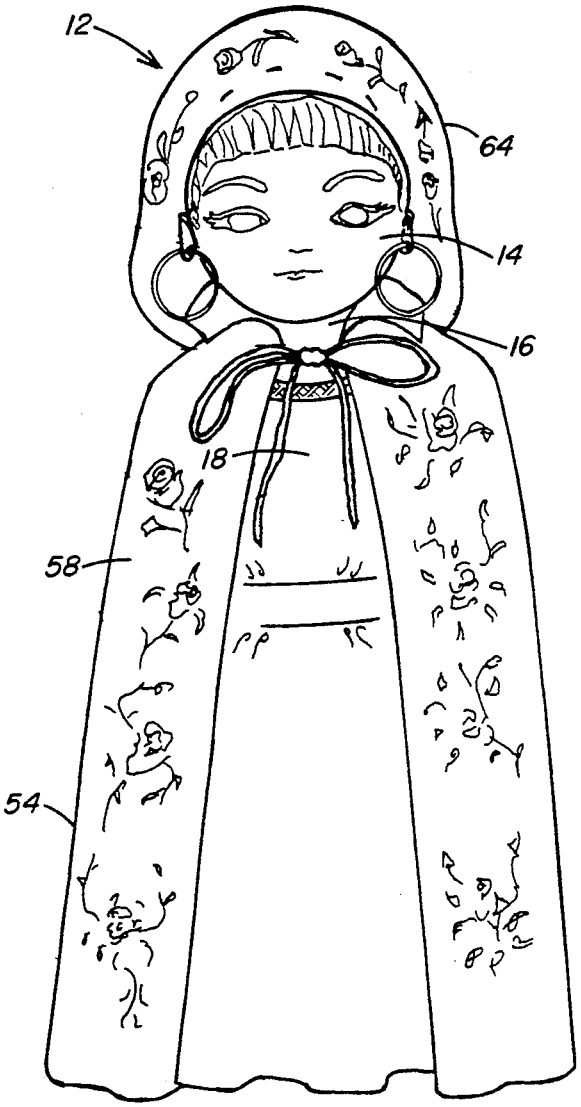
FIG. 10 is a view similar to FIG. 8, illustrating conversion of the doll from the character shown in FIG. 8.
Figure 11:
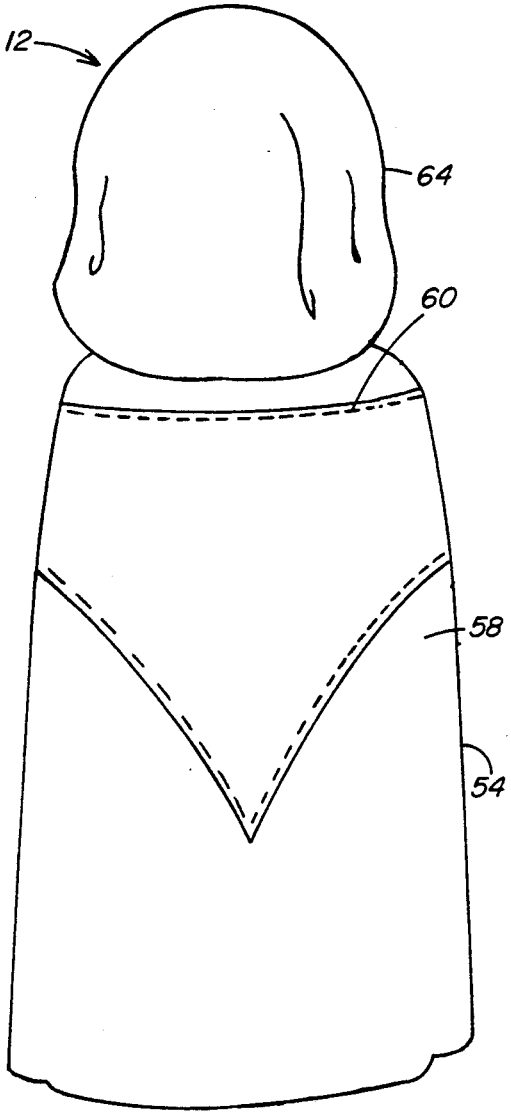
FIG. 11 is a rear elevational view of the doll construction shown in FIG. 10.

Now referring to FIGS. 8–11, there is illustrated an additional embodiment of a doll or puppet construction, generally designated by the numeral 12, in the form of "witch" doll or puppet shown in FIGS. 8 and 9 capable of being converted to a "gypsy lady" character shown in FIGS. 10 and 11. The conversion of the doll or puppet construction 12 shown in FIGS. 8 and 9 from one character to another is accomplished in a manner similar to that described for FIGS. 1–4. The construction 12 includes the basic features of face 14, neck 16, and torso 18 described above. A cape 54 includes one surface 56 shown in FIGS. 8 and 9 that is reversible to surface 58 shown in FIGS. 10 and 11. As shown in FIG. 9, the cape 54 on surface 56 has a pocket 60 for storage of a hat 62 when not in use with the character of the doll shown in FIGS. 10 and 11.

To convert the construction 12 shown in FIGS. 8 and 9 from a "witch" character to a "gypsy lady" character, the hat 62 is removed and inserted in the pocket 60. The cape 54 is then reversed so that the surface 58 is exposed when wrapped around the torso 18. Even with the hat 62 in the pocket 60 and the pocket 60 exposed as shown in FIG. 11, the pocket 60 is constructed to be incorporated in the design of the cape 54. In this manner, the pocket 60 is not readily noticeable as a pocket and appears as an ornamental feature of the cape 54.

The cape 54 includes the hood portion 64 which is stored in the pocket 60 for the character shown in FIGS. 8 and 9. Thus in the conversion from one character to another, the hat 62 is inserted in the pocket 60; while, the hood 64 is withdrawn from the pocket 60. The cape is then secured in position on the doll or puppet construction in the manner shown in FIGS. 10 and 11. With this construction, a mask is not attached to the hood 64; however, a mask can be attached to the hood 64 in the same manner as illustrated in FIG. 5.

For those conversions where it is desired to change the facial expression of the doll or puppet from one costume to another, the mask construction shown in FIG. 6 can also be used with the construction shown in FIGS. 8–11. For example, as shown in FIG. 10, the mask 44 is held in place over the face 14 and secured thereto by the provision of the earrings 46 with connecting pins 48, in a manner similar to the earring connection shown in FIG. 6. The costumes shown in FIGS. 8–11 are also usable on a larger scale by children and adults to convert from one costume character to another.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A costume construction comprising, a loose fitting garment for draping over the body of a wearer, said garment having a first surface with a style presenting a first costume design and a second surface with another style presenting a second costume design, said garment being reversible to convert the style thereof to a selected one of said first and second costume designs, a face mask for use with said loose fitting garment, means for connecting said face mask to said loose fitting garment to support said face mask from said loose fitting garment in a position overlying the face of the wearer, and means for retaining said face mask connected to said loose fitting garment and concealed from view when removed from position on the face of the wearer.

2. A costume construction as set forth in claim 1 which includes, a hood portion connected to said loose fitting garment for positioning over the head of the wearer, said face mask connected to said hood portion for positioning over the face of the wearer when said hood portion is positioned over the head of the wearer, and means for storing said hood portion with said face mask attached in a concealed position on said loose fitting garment when said hood portion is removed from the head of the wearer.

3. A costume construction as set forth in claim 1 which includes, said face mask connected to said loose fitting garment for positioning on the face of the wearer when said garment is worn to expose said first costume design and conceal said second costume design.

4. A costume construction as set forth in claim 1 which includes, said face mask connected to said loose fitting garment and concealed from view when said garment is worn to expose said second costume design and conceal said first costume design.

5. A costume construction as set forth in claim 1 in which, said means for connecting said face mask to said loose fitting garment includes a collar and a hood portion extending from said collar, said hood portion extending from said collar to a position over the head of the wearer, and said face mask connected to said hood portion for suspending said face mask from said collar to cover the face of the wearer when said hood portion is in position over the head of the wearer.

6. A costume construction as set forth in claim 1 in which, said means for retaining said face mask connected to said loose fitting garment includes a pocket positioned on a selected one of said first and second surfaces of said garment, and said face mask connected to said garment for positioning said face mask in said pocket to conceal said face mask from view when a selected one of said first and second costume design is exposed and the other one of said costume designs is concealed.

7. A costume construction as set forth in claim 1 in which, said loose fitting garment includes a cape with said first surface representing a first costume design and said second surface representing a second costume design such that said cape is reversible to provide a reversal of costume designs between said first and second costume designs, said face mask connected to said cape for positioning over the face of the wearer when said cape is worn to portray said first costume design, and said face mask connected to said cape for positioning in said means for retaining when said cape is worn to portray said second costume design.

8. A method for changing a costume from one costume design presentation to another comprising the steps of, positioning a portion of a loose fitting garment styled for presentation as a first selected costume design on a wearer, concealing from view another portion of the loose fitting garment styled for presentation as a second selected costume design on a wearer, connecting a face mask to the loose fitting garment for wearing in the presentation of the first selected costume design, supporting the face mask from the loose fitting garment for positioning the face mask over the face of the wearer to portray the first selected costume design, changing the loose fitting garment on the wearer to conceal from view the first selected costume design and expose the second selected costume design, removing the face mask from the face of the wearer, and concealing the face mask on the loose fitting garment to convert the costume from presentation of the first selected costume design to presentation of the second selected costume design.

9. A method as set forth in claim 8 which includes, storing accessories on the loose fitting garment, concealing the accessories from view when not in use in the presentation of a selected one of the first and second costume designs, and removing selected ones of the accessories from concealment for use with the loose fitting garment in the presentation of a selected one of the costume designs.

10. A method as set forth in claim 8 which includes, connecting a hood to a collar of the loose fitting garment, connecting the face mask to the hood, positioning the hood over the head of the wearer to support the face mask over the face of the wearer in the presentation of the first selected costume design, changing the loose fitting garment to present the second selected costume design and conceal the first selected costume design removing the face mask and hood from the face and head of the wearer, and concealing the face mask and hood on the loose fitting garment from view to disguise the costume representing the first selected costume design and portray the costume representing the second selected costume design.

11. A method as set forth in claim 8 which includes, storing the face mask remaining connected to the loose fitting garment in a compartment concealed from view on the garment when the face mask is removed from use as part of the costume.

12. A method as set forth in claim 8 which includes, suspending the face mask connected to the loose fitting garment in position overlying the face of the wearer to disguise the identity of the wearer in the presentation of the first selected costume design.

13. A method as set forth in claim 8 which includes, concealing the face mask from view on the loose fitting garment to expose the face of the wearer in the conversion of the costume from the first selected costume design to the selected second costume design.

* * * * *